United States Patent [19]

Igarashi et al.

[11] Patent Number: 4,652,315

[45] Date of Patent: Mar. 24, 1987

[54] PRECIPITATION-HARDENING NICKEL-BASE ALLOY AND METHOD OF PRODUCING SAME

[75] Inventors: Masaaki Igarashi, Nishinomiya; Yasutaka Okada, Nara; Kunihiko Yoshikawa, Suita; Takeo Kudo, Nishinomiya, all of Japan

[73] Assignee: Sumitomo Metal Industries, Ltd., Osaka, Japan

[21] Appl. No.: 622,288

[22] Filed: Jun. 19, 1984

[30] Foreign Application Priority Data

Jun. 20, 1983 [JP] Japan ..... 58-109422
Nov. 21, 1983 [JP] Japan ..... 58-217774

[51] Int. Cl.[4] ..... C22F 1/10

[52] U.S. Cl. ..... 148/12.7 R; 148/12.7 N; 148/410; 148/419

[58] Field of Search ..... 420/442, 443, 445–448, 420/451–454, 582, 584–588; 148/12.7 R, 12.7 N, 2, 158, 162, 410, 419

[56] References Cited

U.S. PATENT DOCUMENTS 4,400,210 8/1983 Kudo et al. ..... 420/443

*Primary Examiner*—R. Dean

*Attorney, Agent, or Firm*—Burns, Doane, Swecker & Mathis

[57] ABSTRACT

A precipitation-hardening Ni-base alloy exhibiting improved resistance to corrosion under a corrosive environment containing at least one of hydrogen sulfide, carbon dioxide and chloride ions and method of producing the same are disclosed. The alloy is of the $\gamma''$-phase, or $(\gamma'+\gamma'')$-phase precipitation hardening type in which Ti is restricted to less than 0.40% and is comprised of:

C: not greater than 0.050%,
Si: not greater than 0.50%,
Mn: not greater than 2.0%,
Ni: 40–60%,
Cr: 18–27%,
Ti: less than 0.40%,
Mo: 2.5–5.5% and/or W: not greater than 11%, t $2.5\% \leqq Mo+\frac{1}{2}W \leqq 5.5\%$,
Al: not greater than than 2.0%,
Nb: 2.5–6.0% and/or Ta: not greater than 2.0%, $2.5\% \leqq Nb+\frac{1}{2}Ta \leqq 6.0\%$.

14 Claims, 1 Drawing Figure

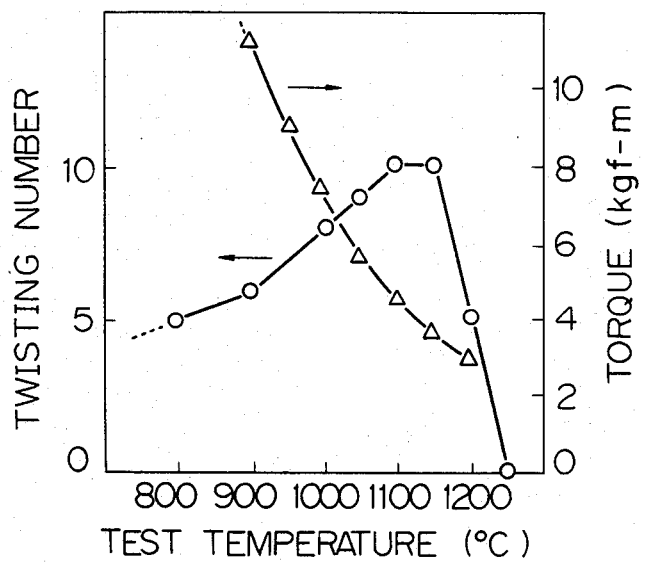
TWISTING NUMBER
0
5
10
TORQUE (kgf-m)
0
2
4
6
8
10
800 900 1000 1100 1200
TEST TEMPERATURE (°C)

PRECIPITATION-HARDENING NICKEL-BASE ALLOY AND METHOD OF PRODUCING SAME

BACKGROUND OF THE INVENTION

This invention relates to a high strength, precipitation-hardening nickel base alloy with improved toughness, which exhibits satisfactory resistance to stress corrosion cracking and hydrogen cracking under a corrosive environment, particularly under a corrosive environment containing at least one of hydrogen sulfide, carbon dioxide and chloride ions.

Since metallic construction members for use in oil wells, chemical plants, geothermal power plants, and the like are required to possess a high degree of strength and corrosion resistance, most prior art construction members are strengthened by means of solid solution hardening+cold rolling hardening. However, construction members to which cold rolling cannot be applied because of having a complicated shape cannot be strengthened by means of such a conventional method.

One of the conventional methods of improving the strength of a nickel base alloy which may be applied to a construction member of a complicated shape is to incorporate Ti and Al (or Nb) as alloying elements so as to cause the precipitation, during heat treatment, of an intermetallic compound mainly composed of $Ni_3(Ti, Al)$, i.e. $\gamma'$-phase, or an intermetallic compound mainly composed of $Ni_3Nb$, i.e. $\gamma''$-phase.

A typical prior art precipitation-hardening alloy of this type is a nickel-base alloy such as Inconel Alloy-718 (tradename), Inconel Alloy X-750 (tradename), Incoloy Alloy-925 (tradename). However, because the conventional alloy of this type is of a low Cr-high Ti-system and $\gamma'$-phase which contains mainly Ti other than Ni precipitates, the corrosion resistance is not satisfactory. For example, Inconel Alloy-718 is a precipitation-hardening Ni-base alloy utilizing the precipitation of $\gamma'$-phase and $\gamma''$-phase with the addition of Nb, Ti and Al. However, since it contains a relatively large amount of Ti and $\gamma'$-phase which contains mainly Ti and Al other than Ni precipitates, the corrosion resistance is degraded, Not only a high level of strength and toughness, but also improved corrosion resistance, namely improved resistance to stress corrosion cracking and hydrogen cracking are required for a construction material which is used under a corrosive environment containing at least one of hydrogen sulfide, carbon dioxide and chloride ions, and usually containing all three, such as found in oil wells, chemical plants, geothermal power plants, etc. A construction material which is used as a construction member for such use is desirably subjected to cold working when the material is used in the form of a plate or pipe in order to increase the strength thereof. However, when the material is in the shape of a valve, joint, bent pipe, etc. to which cold rolling cannot be applied, it must be strengthened by means of precipitation hardening. However, according to the findings of the inventors of this invention, the conventional precipitation-hardening alloy, most of which is a $\gamma'$-phase precipitation-hardening Ni-base alloy with the addition of large amounts of Ti and A1, exhibits degraded resistance to corrosion.

For example, a nickel base alloy which exhibits improved resistance to stress corrosion cracking disclosed in Japanese Patent Laid-Open No. 203741/1982 contains 2.5–5% of Nb, 1–2% of Ti and up to 1% of Al, and is hardened mainly by the precipitation of $\gamma'$-phase of $Ni_3(Ti, Al)$ and $\gamma''$-phase of $Ni_3Nb$ through ageing. However, since the amount of Ti is rather large, it is easily over-aged, precipitating an over-aged phase of an intermetallic compound of $\eta$-$Ni_3Ti$ with the corrosion resistance, particularly the resistance to hydrogen cracking being degraded markedly. Therefore, it is necessary to strictly limit heat treatment conditions as well as ageing conditions in order to improve the corrosion resistance of the alloy of this type.

Japanese Patent Laid-Open No. 123948/1982 discloses an alloy of a similar type containing 0.7–3% of Ti. This alloy also contains a relatively large amount of Ti, resulting in a degradation in corrosion resistance. Since a lower limit of Ti is set, it may be said that the precipitation of $\gamma'$-phase of $Ni_3(Ti, Al)$ is intended in that alloy.

An article titled "High-alloy Materials for Offshore Applications" by T. F. Lemke et al., OTC (Offshore Technology Conference) 4451, May 1983, pp. 71–72 states that Inconel alloys and Incoloy alloys may be used for oil wells. Though these alloys are of the $(\gamma'+\gamma'')$ precipitation hardening type, they contain a relatively large amount of Ti, and some of them contain no Nb.

OBJECTS OF THE INVENTION

A primary object of this invention is to provide an precipitation-hardening nickel base alloy with improved strength, ductility and toughness, exhibiting a satisfactory level of resistance to stress corrosion cracking and hydrogen cracking.

Another object of this invention is to provide a nickel base alloy of the above-mentioned type for use in oil wells, chemical plants and geothermal power plants as a construction material.

Still another object of this invention is to provide a method of producing the above-mentioned nickel base alloy.

SUMMARY OF THE INVENTION

After a long and extensive study of precipitation-hardening nickel base alloys, the inventors of this invention found that the conventional $\gamma'$-phase precipitated nickel base alloy containing Ti as an additive is essentially unsatisfactory in respect to corrosion resistance and it has an unstable metallurgical structure. Namely, the corrosion resistance of a Ti-added alloy, which is the same as that of a Ti- and Nb-added alloy, is not good when $\Gamma'$-phase contains a large amount of Ti. Accordingly, the inventors continued the study of precipitation-hardening Ni-base alloys and found that the precipitation of $\Gamma''$-$Ni_3Nb$ is effective in achieving the purpose of this invention. In addition, the inventors found that suitable conditions exist regarding hot working, heat treatment and ageing for achieving the purpose of this invention.

The inventors also found that the addition of Nb as well as Al is effective to produce an alloy exhibiting not only improved strength, ductility and toughness, but also improved resistance to stress corrosion cracking and hydrogen cracking, even though the precipitation phase is $(\gamma'+\gamma'')$-phase. Namely, Al may be added so as to shorten the time required for precipitation of $\gamma''$-phase during ageing. Due to the addition of Al in a relatively large amount, the precipitation of $\gamma'$-phase of $Ni_3(Nb, Al)$ is inevitable. However, this of $\gamma'$-phase does not markedly deteriorate corrosion resistance and toughness, because it does not contain Ti. On the other hand, when Al is intentionally added, Co may be added so as to suppress adverse effects on corrosion resistance caused by the precipitation of $\gamma'$-phase. Thus, the addition of Co in a relatively large amount is effective to improve such properties as mentioned above even for the $(\gamma'+\gamma'')$-phase precipitation hardening type alloy, the precipitation of which is caused by the addition of Al. Namely, the addition of Co in such a large amount may advantageously strengthen or promote the precipitation hardening of the $(\gamma'+\gamma'')$ phase during ageing without a decrease in corrosion resistance.

According to this invention, the precipitation of $\gamma''$-phase or $(\gamma'+\gamma'')$-phase together with the addition of Co will advantageously improve not only mechanical properties including strength, ductility and toughness, but also the resistance to corrosion including the resistance to stress corrosion cracking and hydrogen cracking.

Thus, this invention resides in a precipitation-hardening Ni-base alloy exhibiting improved resistance to corrosion under a corrosive environment containing at least one of hydrogen sulfide, carbon dioxide and chloride ions, the alloy being of the $\gamma''$-phase precipitation-hardening type and consisting of:

C: not greater than 0.050%,
Si: not greater than 0.50%,
Mn: not greater than 2.0%,
Ni: 40–60%,
Cr: 18–27%,
Ti: less than 0.40%,
Mo: 2.5–5.5% and/or W :not greater than 11%, such that $2.5\% \leqq Mo+\frac{1}{2}W \leqq 5.5\%$,
Al: less than 0.30%,
Nb: 2.5–6.0% and/or Ta: not greater than 2.0%, such that $2.5\% \leqq Nb+\frac{1}{2}Ta \leqq 6.0\%$,
S: not greater than 0.0050%, N: not greater than 0.030%,
P: not greater than 0.020%,
Co: 0–15%,
Cu 0–2.0%,
B: 0–0.10%
REM: 0–0.10%, Mg: 0–0.10%, Ca: 0–0.10%,
Y: 0–0.20%,
Fe and incidental impurities: balance.

In another aspect, this invention resides in a precipitation-hardening Ni-base alloy exhibiting improved resistance to corrosion under a corrosive environment containing at least one of hydrogen sulfide, carbon dioxide and chloride ions, the alloy being of the $(\gamma'+\gamma'')$-phase precipitation hardening type and consisting of:

C: not greater than 0.050%,
Si: not greater than 0.50%,
Mn: not greater than 2.0%,
Ni: 40–60%,
Cr: 18–27%,
Mo: 2.5–5.5% and/or W: not greater than 11%, such that $2.5\% \leqq Mo+\frac{1}{2}W \leqq 5.5\%$,
Al: 0.3–2.0%,
Ti: less than 0.4%,
Nb: 2.5–6.0% and/or Ta: not greater than 2.0%, such that $2.5\% \leqq Nb+\frac{1}{2}Ta \leqq 6.0\%$,
Co: 0–15%,
S: not greater than 0.0050%, N: not greater than 0.030%,
P: not greater than 0.020%,
Cu: 0–2.0%,
B: 0–0.10%,
REM: 0–0.10%,
Mg: 0–0.10%, Ca: 0–0.10%,
Y: 0–0.20%,
Fe and incidental impurities: balance.

In a still another aspect, this invention resides in a method of producing a precipitation-hardening Ni-base alloy exhibiting improved resistance to corrosion under a corrosive environment containing at least one of hydrogen sulfide, carbon dioxide and chloride ions, the alloy being of the precipitation hardening type and consisting of:

C: not greater than 0.050%,
Si: not greater than 0.50%,
Mn: not greater than 2.0%,
Ni: 40–60%,
Cr: 18–27%,
Mo: 2.5–5.5% and/or W: not greater than 11%, wherein $2.5\% \leqq Mo+\frac{1}{2}W \leqq 5.5\%$,
Al: not greater than 2.0%,
Ti: less than 0.40%,
Nb: 2.5–6.0% and/or Ta: not greater than 2.0%, wherein $2.5\% \leqq Nb+\frac{1}{2}Ta \leqq 6.0\%$,
S: not greater than 0.0050%,
N: not greater than 0.030%,
P: not greater than 0.020%,
Co: 0–15%,
Cu: 0–2.0%,
B: 0–0.10%,
REM: 0–0.10%,
Mg: 0–0.10%,
Ca: 0–0.10%,
Y: 0–0.20%,
Fe and incidental impurities: balance, the method comprising hot rolling the alloy with a reduction in area of 50% or more within a temperature range of 1200 °C. to 800 °C. maintaining the thus hot rolled alloy at a temperature of 1000°–1200° C. for from 3 minutes to 5 hours, followed by cooling at a cooling rate higher than air cooling such that the cooling rate within the temperature range of between 900° C. and 500° C. is 10 °C./min or higher, then carrying out ageing one or more times at a temperature of 500° C.–750° C. for from one hour to 200 hours.

The term "Y''-phase" or "Y''-phase precipitation-hardening type" used herein means that an $\gamma''$-phase indicated by the formula $Ni_3Nb$ precipitates during ageing and the strengthening of an alloy is predominantly achieved by the precipitation of this $\gamma''$-phase. Usually the $\gamma''$-phase comprises more than 50% of the total amount of precipitates.

The term "$(\gamma'+\gamma'')$ phase" or "$(\gamma'+\gamma'')$ phase precipitation-hardening type" used herein means that a small amount of $\gamma'$-phase shown by the formula $Ni_3(Nb, Al)$ and a large amount of $\gamma''$-$Ni_3Nb$ precipitate during ageing and the hardening is mainly achieved by the precipitation of the $\gamma''$-phase. The chemical composition of $\gamma'$-phase except Ni can be controlled by changing a chemical composition of the alloy.

Thus, according to this invention, there is provided an alloy which can exhibit improved resistance to stress corrosion cracking as well as hydrogen cracking under a corrosive environment containing at least one of hydrogen sulfide, carbon dioxide and chloride ions, usually containing all three, such as found in oil wells, chemical plants, and geothermal power plants.

In particular, according to one of the embodiments of this invention, a $\gamma''$-phase precipitation-hardening nickel-base alloy having high strength and toughness with improved corrosion resistance can be obtained, though it contains a relatively high content of Cr, and the presence of Ti is limited to less than 0.4%.

According to another embodiment of this invention, a $(\gamma'+\gamma'')$ phase precipitation hardening nickel base alloy with the addition of Nb as well as Al can be obtained with improved resistance to stress corrosion cracking as well as hydrogen cracking. In this case, Al in an amount of 0.3–2.0% may be added to shorten the time required to effect precipitation of $\gamma''$-phase. Moreover, with the addition of Al in such a large amount, the precipitation of $\gamma'$-phase results, and Co in an amount of not more than 15% may be added for further improving corrosion resistance of the alloy. For the same purpose B in an amount of not more than 0.10% may be added.

In still another embodiment of this invention, hot working and heat treatment conditions are determined for promoting the precipitation of $\gamma''$-phase which is effective to improve not only corrosion resistance, but also mechanical properties of a nickel base alloy while restricting the incorporation of Ti in the alloy. In still another embodiment of this invention, hot working and heat treatment conditions are determined for promoting the precipitation of $(\gamma'+\gamma'')$ phase, i.e. $Ni_3Nb$ plus $Ni_3(Nb, Al)$ which is also effective to improve not only corrosion resistance, but also mechanical properties of a nickel base alloy.

BRIEF DESCRIPTION OF THE DRAWINGS

The sole FIGURE is a graph showing experimental results of a high temperature twisting test.

DETAILED DESCRIPTION OF PREFERRED EMBODIMENTS

The reasons why the alloy composition and working conditions are defined as in the above will be explained below.

CHEMICAL COMPOSITION

C: The presence of much carbon suppresses precipitation hardening. In addition, when it is added in an amount of larger than 0.050%, the amount of inclusions such as NbC, TiC, etc. increases, deteriorating ductility, toughness and corrosion resistance. Preferably, the carbon content is not greater than 0.020%, and ductility as well as toughness will be further improved when the carbon content is limited to not greater than 0.010%.

Si, Mn: Si and Mn are added as deoxidizing agents and desulfurizing agents. However, when Si is over 0.50%, intermetallic compounds such as $\Sigma$-, $\mu$-, P-, and Laves-phases (hereunder collectively referred to as "TCP-phase") which have undesirable effects on ductility and toughness are easily formed. The upper limit of Si, is therefore 0.50%. Furthermore, considering weldability, the Si content is preferably limited to not greater than 0.10%. Mn is preferably added in an amount of not greater than 2.0%, preferably not greater than 0.80%.

Ni: This invention, in one aspect, is characterized by the precipitation of intermetallic compounds of $Ni_3Nb$ ($\gamma''$-phase), $Ni_3(Nb, Al)$ ($\gamma'$-phase), which are precipitated in an austenitic matrix during ageing. It is necessary to incorporate a sufficient amount of Ni in the alloy of this invention so as to stabilize the austenitic matrix without forming a TCP-phase by adjusting the Cr, Mo, Fe and Co content. The formation of this phase is not desirable from the standpoints of ductility, toughness and corrosion resistance. For this purpose, 40% or more of Ni is necessary. Preferably, the Ni content is 45% or more. However, when the nickel content is over 60%, the resistance to hydrogen cracking is degraded markedly, and the nickel content is desirably limited to 60% or less. Preferably, the nickel content is 50% to 55%. In addition, when Co is added in an amount of more than 2.0%, the nickel content may be at a lower level within the range defined above.

Cr: The addition of Cr as well as Mo increases corrosion resistance. For this purpose, it is necessary to incorporate Cr in an amount of 18% or more. When the Cr content is over 27%, hot workability deteriorates, and a TCP-phase easily forms. The formation of the TCP-phase is undesirable from the standpoints of ductility, toughness and corrosion resistance. Preferably, the Cr content is 22–27%.

Mo, W: These elements increase the resistance to pitting corrosion when they are added together with Cr. This effect is marked when the Mo content is 2.5% or more. However as the Mo content increases, the formation of the TCP phase, which has undesirable effects on ductility, toughness and corrosion resistance, takes place easily. Thus, it is desirable that the upper limit thereof be set at 5.5%. Tungsten (W) acts in substantially the same way as molybdenum, but is required to be added in twice the amount of Mo to obtain the same effect. Thus, molybdenum may be partly replaced by tungsten in a 2:1 ratio. When W is added in an amount of more than 11%, the formation of the above-mentioned intermetallic compounds takes place easily, as in the case of Mo. The upper limit of W is defined as 11%.

In addition, according to this invention, at least one of Mo (2.5%–5.5%) and W (not greater than 11%) is added such that $2.5\% \leqq Mo+\frac{1}{2}W \leqq 5.5\%$. When the content of Mo and/or W falls outside this range, the resistance to corrosion of the resulting alloy is not satisfactory, and the ductility and toughness deteriorate.

Ti: When Ti is added in an amount of over 0.4%, the Ti precipitates as $Ni_3Ti$ which markedly deteriorates the resistance to corrosion. Therefore, Ti is added as a deoxidizing agent in an amount of less than 0.40%, preferably less than 0.20%.

Al: Al is the most suitable deoxidizing agent for Ni-base alloys. As the amount of Al increases, its effects on deoxidization become remarkable. However, when the Al content exceeds 0.30%, the effects thereof saturate. Therefore, Al is added in an amount of less than 0.30%, preferably less than 0.15%.

However, Al has an effect of promoting precipitation hardening, i.e. it shortens the time required to effect the precipitation of the $\gamma''$-phase during ageing. In an alternative embodiment, therefore, Al is intentionally added so as to promote precipitation hardening, though the addition of Al in an amount of 0.30% or more results in the formation of $\gamma'$-$Ni_3(Nb, Al)$ phase, not markedly deteriorating corrosion resistance. In this case, the addition of Co in an amount of not greater than 15% is rather effective to improve corrosion resistance.

Nb, Ta: These elements precipitate as $\gamma''$-$Ni_3(Nb, Ta)$ increasing the strength of the alloy. This effect is remarkable when the total of $Nb+\frac{1}{2}Ta$ is 2.5% or more. However, when it is over 6.0%, hot workability deteriorates. In addition, the formation of the TCP-phase takes place easily. According to this invention, Nb is limited to 2.5%–6.0%, preferably 2.5%–5.0% and Ta is limited to not greater than 2.0%. If the amounts added fall outside of these ranges, the addition of these elements does not improve strength and deteriorates the ductility, toughness and hot workability.

Ta is about half as effective as Nb. Therefore, within the range of Nb=2.5-6.0% and Ta=not greater than 2.0%, at least one of Nb and Ta is added in an amount as defined by the formula:

$$2.5\% + \tfrac{1}{2}Ta \leqq 6.0\%$$

Co: The addition of Co is effective to improve not only mechanical properties, but also corrosion resistance. Namely, the addition of Co in an amount of not greater than 15% advantageously strengthens or promotes the precipitation hardening caused by the formation of the $\gamma''$-phase or $(\gamma'+\gamma'')$-phase during ageing without deterioration in corrosion resistance. Moreover, as mentioned before, Co is also effective to suppress the adverse effects resulting when a relatively large amount of Al is added, and therefore it may be added in an amount of not more than 15%. Preferably, Co may be added in an amount of 2.0-15%.

P,S: P and S precipitate in grain boundaries during hot working and/or ageing, resulting in degradation in hot workability as well as corrosion resistance. Therefore, according to this invention, P is limited to not greater than 0.020%, preferably not greater than 0.015%, while S is limited to not greater than 0.0050%, and preferably not greater than 0.0010%.

N: The presence of nitrogen causes the formation of inclusions, which results in anisotropy of various properties of the material. Thus, the N content is limited to not more than 0.030%, preferably not more than 0.010%.

Cu: The addition of Cu is effective to improve corrosion resistance. However, the effects thereof saturates when Cu is added in an amount over 2.0%. Thus, if Cu is added, the upper limit thereof is 2.0%.

B: Boron is added, if necessary, in order to further improve hot workability and toughness as well as corrosion resistance. However, when boron is added over 0.10%, an undesirable compound to ductility, toughness and hot workability easily forms.

REM, Mg, Ca, Y: These elements, when added in a small amount, may improve hot workability. However, when added in amounts over 0.10%, 0.10%, 0.10% and 0.20%, respectively, some low-melting compounds easily form, decreasing hot workability.

Other elements: The presence of Sn, Zn, Pb, etc. does not affect the alloy of this invention at all, so long as they are present as impurities. Therefore, the presence of these elements is allowed as impurities up to 0.10%, for each. When they are over the upper limits, hot workability and/or corrosion resistance will be decreased.

HOT ROLLING

Since Nb is added in the alloy of this invention, a low-melting compound easily forms in grain boundaries during solidification. Therefore, it is necessary to strictly restrict the heating and working temperatures for hot working. When the initial heating temperature, i.e. the temperature at the beginning of hot rolling is over 1200° C., grain boundaries becomes brittle. On the other hand, when the finishing temperature is lower than 800° C., it is difficult to work because of degradation in ductility. Thus, according to this invention, hot working is advantageously carried out within the temperature range of 1200°-800° C., preferably 1150°-850 °C.

In addition, the incorporation of Nb and Mo sometimes causes micro- and macro-segregation during solidification, and such segregations remaining in final products also cause decreases in toughness and corrosion resistance. Therefore, the degree of working during hot working is defined as 50% or more in terms of a reduction in area so as to prevent the micro- and macro-segregation of Nb and Mo. Furthermore, this also makes grain size fine and improves ductility and toughness.

HEAT TREATMENT

In order to promote the precipitation of not only $\gamma''$-$Ni_3Nb$ and sometimes also $\gamma'$-$Ni_3(Nb, Al)$ during ageing, it is necessary to carry out complete solution treatment. For this purpose, the hot rolled product is heated at 1000°-1200° C., preferably 1050°-1150° C. for three minutes to 5.0 hours, preferably from ten minutes to 5.0 hours, and cooled at a cooling rate higher than air cooling. When being cooled in a temperature range of 900°-500° C., a brittle phase forms easily, and therefore the product should be cooled in this temperature range at a cooling rate of 10° C./min or higher so as to prevent the precipitation of such a brittle phase.

AGEING TREATMENT

The ageing of the alloy of this invention will make the $\gamma''$-$Ni_3Nb$ disperse uniformly throughout the matrix. This results in high strength, satisfactory ductility and corrosion resistance in the final product. However, when the ageing temperature is lower than 500° C. or the ageing peiord is shorter than 1.0 hour, a satisfactory level of strength cannot be obtained. On the other hand, when the temperature is over 750° C., it will easily result in over-ageing, and $\gamma''$-$Ni_3Nb$ sometimes together with $\gamma'$-$Ni_3(Nb, Al)$ become coagulated and coarse. $\delta$-$Ni_3Nb$ and a TCP-phase also form with a decrease in strength and toughness. Therefore, though an exact mechanism of precipitation or behavior of alloying elements during ageing is determined by the preceeding solution treatment conditions, by the amount of niobium and aluminium added, and by the content of Ni, Co and Fe, the precipitation is markedly promoted when the ageing is, in general, carried out at a temperature of 500°-750° C.

Although a suitable ageing period will depend on the ageing temperature employed, ageing for at most 200 hours will be enough to obtain satisfactory results and ageing for at least one hour will be necessary. Ageing for 5-20 hours is enough.

In order to obtain a satisfactory level of strength, ductility and corrosion resistance, it is desirable to finely and uniformly disperse $\gamma''$-$Ni_3Nb$, sometimes together with $\gamma'$-$Ni_3(Nb, Al)$, in an austenitic matrix. For this purpose, it is desirable to effect the ageing at a temperature of 600°-750° C.

When ageing is carried out two or more times according to this invention, an ageing step following to the preceding ageing step may be carried out by reheating the aged material to an ageing temperature after it is once cooled to room temperature. Alternatively, the succeeding step of ageing may be carried out by furnace cooling or heating to an ageing temperature after finishing the preceding ageing without cooling the once aged material to room temperature.

Thus, according to this invention, an alloy material with improved properties can be obtained which has a 0.2% yield point of 63 kgf/mm$^2$ or more, preferably 77 kgf/mm$^2$ or more, an elongation of 20% or more, a drawing ratio of 30% or more, an impact value of 5 kgf-m/cm$^2$, preferably 10 kgf-m/cm$^2$ or more, and which also exhibits remarkable corrosion resistance, i.e. satisfactory resistance to stress corrosion cracking and hydrogen cracking.

As is apparent from the foregoing, a product made of the alloy of this invention exhibits a high level of strength because it utilizes precipitation hardening of $\gamma''$-phase which is an intermetallic compound of $Ni_3Nb$, and even if the product is of a complicated shape to which cold working cannot be applied, such as a valve body for use in oil well tubing or casing, it can exhibit improved strength, toughness and corrosion resistance without application of cold working and the like.

This invention will further be described in conjunction with working examples, which are presented merely for illustrative purposes, and not restrictive to this invention in any way. Unless otherwise indicated, the term "%" means "% by weight".

EXAMPLE 1

Alloy samples having the chemical compositions shown in Table 1 were prepared and treated through hot working, heat treatment and ageing under the conditions shown in Table 2 to form precipitation-hardened nickel-base alloys.

Mechanical properties and corrosion resistance of the resulting alloys were determined. The results are also shown in Table 2.

A tensile strength test was carried out at room temperature using a test piece 3.5 mm in diameter and 20.0 mm in gage length. Impact values are those of Charpy impact test carried out at 0° C. using a 2.0 mm V-notched test piece having the dimensions of 5.0 mm×10 mm×55 mm.

The corrosion resistance was determined by a stress corrosion cracking test carried out at 250° C. using a 25% NaCl 0.5% $CH_3COOH$-15atm $H_2S$-10atm $CO_2$ solution (pH=2). In addition, the hydrogen cracking test was carried out at 25° C. under NACE conditions (5% NaCl-0.5% $CH_3COOH$-latm $H_2S$) using a 0.25R-U-notched test piece fixed by a carbon steel coupling.

In Table 2, the symbol "O" indicates the cases where no cracking occurred and "X" indicates the occurrence of cracking.

For Comparative Alloys Nos. 29–34, the alloy composition is the same as that of this invention, but the precipitated phase is a little different from alloys of this invention because of differences in treating conditions. For Comparative Alloys Nos. 35–44, the alloy composition differs from that of this invention.

In all of the comparative alloys, one or more of strength, ductility and toughness are decreased in comparison with those properties of the alloy of this invention.

Alloys Nos. 45–56 are Ti-added and Al-added conventional precipitation hardening type alloys which are shown merely for comparative purposes. As is apparent from the data shown in Table 2, the conventional alloys generally exhibit satisfactory strength properties, but they are much inferior to the alloy of this invention regarding corrosion resistance. This means that the corrosion resistance cannot be improved without a sacrifice of strength.

The test results of high temperature twisting for Alloy Nos 1–14 and Alloy Nos. 29–34 are summarized in the accompanying FIGURE. The open circles show twisting numbers and the open triangles show the values of torque. As is apparent from the test data, the torsion values decrease rapidly at a temperature over 1200° C. This means that since the alloy of this invention contains a relatively large amount of Nb, low-melting compounds form and precipitate along the grain boundaries when worked at a temperature higher than 1200° C.

EXAMPLE 2

Alloy samples having the chemical compositions shown in Table 3 were prepared and treated through hot working, heat treatment and ageing under the conditions shown in Table 4 to produce precipitation-hardening nickel-base alloys.

Mechanical properties and corrosion resistance of the resulting alloys were determined in the same manner as in Example 1. The results are also shown in Table 4.

In Table 4, the symbol "O" indicates the cases wherein no cracking occurred and "X" indicates the occurrence of cracking.

Comparative Alloys Nos. 25–30 are alloys in which the alloy composition is the same as that of this invention, but the precipitated phase is a little different from those of this invention because of differences in treating conditions. Comparative Alloy Nos. 31–36 are alloys in which the alloy composition differs from that of this invention.

Alloys Nos. 37–44 are Ti-added conventional ones, and the same thing can be said as in Example 1.

In all of the comparative alloys, one or more of strength, ductility and toughness are decreased in comparison with the alloy of this invention.

EXAMPLE 3

Alloy samples having the chemical compositions shown in Table 5 were prepared and treated through hot working, heat treatment and ageing under the conditions shown in Table 6 to provide precipitation-hardening nickel base alloys.

Mechanical properties and corrosion resistance of the resulting alloys were determined in the same manner as in Example 1. The results are also shown in Table 6.

In Table 6, the symbol "O" indicates the cases wherein no cracking occurred and "X" indicates the occurrence of cracking.

Comparative Alloy Nos. 21–26 are alloys in which the alloy composition is the same as that of this invention, but the precipitated phase is a little different from those of this invention because of differences in treating conditions.

In these comparative alloys, one or more of strength, ductility and toughness are decreased in comparison with the alloy of this invention.

Examples Nos. 27–33 are examples of this invention and the Co content is rather small in comparison with the other alloys according to this invention. These examples indicate that it is necessary to lengthen the treating time so as to achieve the same level of strength as that of a high-Co alloy.

Alloys Nos. 34–41 are Ti-added and al-added conventioonal ones, and the same thing can be said as in Example 1.

As is apparent from the foregoing, according to this invention it is possible to provide a high strength precipitation hardening type alloy exhibiting improved resistance to stress corrosion cracking and hydrogen cracking. The alloy of this invention may advantageously be manufactured by a series of manufacturing and treating steps defined in this invention. Furthermore, the addition of Co in a relatively large amount may shorten the ageing time in comparison with that required in the prior art.

Although this invention has been described with reference to preferred embodiments it is to be understood that variations and modifications may be employed without departing from the concept of this invention defined in the following claims.

TABLE 1

| Alloy No. | CHEMICAL COMPOSITION (% by weight) | | | | | | | | | | | | | |
|---|---|---|---|---|---|---|---|---|---|---|---|---|---|---|
| | C | Si | Mn | P | S | Ni | Cr | Mo | Fe | Ti | Al | Nb | N | Others |
| 1 | 0.0080 | 0.11 | 0.63 | 0.004 | 0.003 | 51.61 | 25.11 | 3.50 | 15.02 | 0.10 | 0.21 | 3.69 | 0.0040 | 0.0068 Mg |
| 2 | " | " | " | " | " | " | " | " | " | " | " | " | " | " |
| 3 | " | " | " | " | " | " | " | " | " | " | " | " | " | " |
| 4 | " | " | " | " | " | " | " | " | " | " | " | " | " | " |
| 5 | " | " | " | " | " | " | " | " | " | " | " | " | " | " |
| 6 | " | " | " | " | " | " | " | " | " | " | " | " | " | " |
| 7 | " | " | " | " | " | " | " | " | " | " | " | " | " | " |
| 8 | " | " | " | " | " | " | " | " | " | " | " | " | " | " |
| 9 | " | " | " | " | " | " | " | " | " | " | " | " | " | " |
| 10 | " | " | " | " | " | " | " | " | " | " | " | " | " | " |
| 11 | " | " | " | " | " | " | " | " | " | " | " | " | " | " |
| 12 | " | " | " | " | " | " | " | " | " | " | " | " | " | " |
| 13 | " | " | " | " | " | " | " | " | " | " | " | " | " | " |
| 14 | " | " | " | " | " | " | " | " | " | " | " | " | " | " |
| 15 | 0.049 | 0.10 | 0.63 | 0.004 | 0.004 | 51.51 | 24.95 | 3.52 | 13.70 | 0.099 | 0.24 | 3.69 | 0.0039 | 1.5 Co |
| 16 | 0.018 | 0.43 | 0.64 | 0.009 | 0.001 | 51.60 | 24.40 | 3.40 | 13.76 | 0.16 | 0.061 | 3.69 | 0.029 | 1.8 Cu, 0.0055 Mg |
| 17 | 0.012 | 0.24 | 1.80 | 0.004 | 0.003 | 52.02 | 24.59 | 3.37 | 13.01 | 0.10 | 0.16 | 3.59 | 0.0052 | 0.0060 Ca, 1.1 Co |
| 18 | 0.010 | 0.08 | 0.78 | 0.002 | 0.004 | 45.52 | 24.97 | 3.48 | 21.10 | 0.18 | 0.21 | 3.66 | 0.0044 | 0.0085 Y |
| 19 | 0.012 | 0.24 | 0.66 | 0.004 | 0.004 | 59.46 | 25.34 | 3.34 | 6.80 | 0.12 | 0.20 | 3.20 | 0.0064 | 0.60 Ta, 0.0090 Mg |
| 20 | 0.012 | 0.24 | 0.66 | 0.005 | 0.004 | 50.68 | 18.34 | 3.37 | 22.85 | 0.13 | 0.20 | 3.48 | 0.0082 | 0.009 Ce |
| 21 | 0.012 | 0.24 | 0.66 | 0.005 | 0.004 | 50.23 | 26.89 | 3.52 | 12.83 | 0.13 | 0.20 | 3.47 | 0.0054 | 1.80 W, 0.0060 B |
| 22 | 0.010 | 0.25 | 0.65 | 0.003 | 0.003 | 50.19 | 24.23 | 2.54 | 18.32 | 0.13 | 0.20 | 3.47 | 0.0043 | 0.0020 Sn |
| 23 | 0.011 | 0.27 | 0.63 | 0.010 | 0.003 | 50.86 | 25.21 | 5.42 | 13.59 | 0.18 | 0.14 | 3.67 | 0.0044 | 0.0056 Pb |
| 24 | 0.0056 | 0.25 | 0.62 | 0.010 | " | 49.97 | 25.01 | 3.49 | 6.28 | 0.38 | 0.27 | 3.61 | 0.0030 | 0.0079 Zn, 0.0070 B |
| 25 | 0.020 | 0.23 | 0.70 | 0.005 | 0.005 | 50.52 | 25.88 | 5.41 | 13.15 | 0.15 | 0.21 | 2.51 | 0.0062 | 1.2 Co |
| 26 | 0.017 | 0.20 | 0.62 | 0.004 | 0.003 | 51.93 | 24.96 | 3.87 | 13.29 | 0.11 | 0.10 | 4.89 | 0.0077 | 0.0060 Mg |
| 27 | " | " | " | " | " | " | " | " | " | " | " | " | " | " |
| 28 | " | " | " | " | " | " | " | " | " | " | " | " | " | " |
| 29 | 0.0080 | 0.11 | 0.63 | 0.004 | 0.003 | 51.61 | 25.11 | 3.50 | 15.02 | 0.10 | 0.21 | 3.69 | 0.0040 | 0.0068 Mg |
| 30 | " | " | " | " | " | " | " | " | " | " | " | " | " | " |
| 31 | " | " | " | " | " | " | " | " | " | " | " | " | " | " |
| 32 | " | " | " | " | " | " | " | " | " | " | " | " | " | " |
| 33 | " | " | " | " | " | " | " | " | " | " | " | " | " | " |
| 34 | " | " | " | " | " | " | " | " | " | " | " | " | " | " |
| 35 | 0.078* | 0.10 | 0.65 | 0.005 | 0.005 | 51.29 | 24.95 | 3.52 | 15.44 | " | 0.22 | 3.72 | 0.0088 | 0.0047 Mg, 0.0060 B |
| 36 | 0.012 | 0.33 | 0.66 | 0.004 | " | 62.77* | 25.05 | 6.00* | None* | 0.13 | 0.21 | 3.51 | 0.0044 | |
| 37 | 0.011 | 0.060 | 0.81 | 0.002 | 0.004 | 39.19* | 25.02 | 2.94 | 26.66 | 0.11 | 0.23 | 3.75 | 0.010 | 1.2 Cu |
| 38 | 0.013 | 0.18 | 0.72 | 0.005 | 0.005 | 50.28 | 16.88* | 3.33 | 24.61 | 0.11 | 0.22 | 3.63 | 0.0071 | |
| 39 | 0.015 | 0.20 | 0.66 | 0.004 | 0.003 | 51.20 | 28.01* | 3.35 | 7.66 | 0.10 | 0.24 | 3.55 | 0.0060 | 5.0 W |
| 40 | 0.010 | 0.33 | 0.70 | 0.004 | 0.005 | 50.77 | 24.82 | 2.00* | 17.61 | 0.11 | 0.13 | 3.50 | 0.0088 | |
| 41 | 0.0082 | 0.14 | 0.66 | 0.003 | 0.005 | 57.05 | 21.44 | 7.50* | 9.18 | 0.13 | 0.20 | 3.67 | 0.0099 | |
| 42 | 0.012 | 0.33 | 0.66 | 0.004 | 0.005 | 52.77 | 25.05 | 5.50 | 10.50 | 1.02* | 0.21 | 3.51 | 0.0044 | |
| 43 | 0.014 | 0.27 | 0.68 | 0.005 | 0.003 | 51.65 | 25.77 | 5.27 | 9.28 | 0.15 | 0.88 | 3.67 | 0.0052 | 3.2 Ta*, 0.012B |
| 44 | 0.021 | 0.11 | 0.70 | 0.006 | 0.004 | 51.26 | 24.88 | 3.72 | 16.92 | 0.13 | 0.24 | 2.00* | 0.0070 | |
| 45 | 0.0051 | 0.27 | 0.63 | 0.007 | 0.003 | 50.17 | 24.87 | 3.33 | 17.80 | 2.69* | 0.15 | None | 0.0028 | 0.0093 Mg, 0.0042 B |
| 46 | " | " | " | " | " | " | " | " | " | " | " | " | " | " |
| 47 | " | " | " | " | " | " | " | " | " | " | " | " | " | " |
| 48 | 0.0080 | 0.26 | 0.60 | 0.009 | " | 57.49 | 24.33 | 3.26 | 11.20 | 2.58* | 0.13 | " | 0.0025 | 0.0074 Mg, 0.0033 B |
| 49 | " | " | " | " | " | " | " | " | " | " | " | " | " | " |
| 50 | " | " | " | " | " | " | " | " | " | " | " | " | " | " |
| 51 | 0.0058 | 0.25 | 0.64 | 0.008 | " | 68.00* | 25.11 | 3.41 | None* | 2.72* | 0.13 | " | 0.0038 | 0.0063 Mg |
| 52 | " | " | " | " | " | " | " | " | " | " | " | " | " | " |
| 53 | " | " | " | " | " | " | " | " | " | " | " | " | " | " |
| 54 | 0.016 | 0.010 | 0.81 | 0.002 | 0.004 | 50.30 | 24.43 | 3.24 | 17.70 | 3.37* | 0.12 | " | 0.0020 | 0.0077 Mg |
| 55 | " | 0.008 | 0.78 | 0.001 | 0.003 | 49.79 | 24.27 | 3.28 | 17.93 | 1.69* | 2.22* | " | 0.0025 | 0.0089 Mg |
| 56 | 0.015 | 0.012 | 0.83 | " | " | 49.13 | 24.05 | 3.26 | " | 0.83* | 3.93* | " | 0.0064 | 0.0056 Mg |

*Outside the range of this invention

TABLE 2

| Alloy No. | Class | Manufacturing Conditions: Hot Working Conditions: Initial Temp. | Finishing Temp. | Reduction in area | Heat Treatment Conditions | Ageing Conditions | Mechanical Properties: 0.2% Y.P. kgf/mm² | T.S. kgf/mm² | EL. % | D.R. % | I.V. kgf-m/cm² | Corrosion Resistance: SCCT | HCT | Type of Precipitate |
|---|---|---|---|---|---|---|---|---|---|---|---|---|---|---|
| 1 | This Invention Alloys | 1200° C. | 800° C. | 75% | 1200° C. × 1.0 Hr, W.Q. | 700° C. × 100 Hr, A.C. | 74 | 107 | 31 | 36 | 7.5 | O | O | I |
| 2 | | " | " | " | " | 650° C. × 100 Hr, A.C. | 84 | 110 | 35 | 39 | 8.7 | O | O | " |
| 3 | | " | " | " | " | 600° C. × 100 Hr, A.C. | 63 | 97 | 51 | 54 | 20 | O | O | " |
| 4 | | " | " | " | " | 650° C. × 20 Hr, A.C. | 63 | 98 | 42 | 47 | 16 | O | O | " |
| 5 | | " | " | " | 1000° C. × 1.0 Hr, W.Q. | 700° C. × 100 Hr, A.C. | 78 | 112 | 32 | 40 | 7.0 | O | O | " |
| 6 | | " | " | " | " | 650° C. × 100 Hr, A.C. | 88 | 114 | 27 | 46 | 7.2 | O | O | " |
| 7 | | " | " | " | " | 600° C. × 100 Hr, A.C. | 67 | 102 | 44 | 56 | 17 | O | O | " |
| 8 | | " | " | " | " | 650° C. × 20 Hr, A.C. | 67 | 104 | 38 | 47 | 14 | O | O | " |
| 9 | | 1000 | 900 | " | 1200° C. × 1.0 Hr, W.Q. | 650° C. × 20 Hr, A.C. | 65 | 98 | 42 | 55 | 17 | O | O | " |
| 10 | | " | " | " | " | 650° C. × 50 Hr, A.C. | 70 | 105 | 30 | 38 | 7.7 | O | O | " |
| 11 | | " | " | " | " | 650° C. × 100 Hr, A.C. | 82 | 107 | 27 | 31 | 8.2 | O | O | " |
| 12 | | " | " | " | 1000° C. × 1.0 Hr, W.Q. | 650° C. × 20 Hr, A.C. | 66 | 99 | 40 | 57 | 15 | O | O | " |
| 13 | | " | " | " | " | 650° C. × 50 Hr, A.C. | 74 | 112 | 28 | 42 | 7.2 | O | O | " |
| 14 | | " | " | " | " | 650° C. × 100 Hr, A.C. | 84 | 109 | 27 | 33 | 7.8 | O | O | " |
| 15 | | 1150 | " | " | 1150° C. × 1.0 Hr, W.Q. | " | 84 | 114 | 29 | 39 | 7.2 | O | O | " |
| 16 | | " | " | " | " | " | 84 | 105 | 25 | 36 | 5.9 | O | O | " |
| 17 | | " | " | " | " | " | 86 | 109 | 26 | 37 | 6.7 | O | O | " |
| 18 | | " | " | " | " | " | 90 | 116 | 24 | 31 | 5.4 | O | O | " |
| 19 | | " | " | " | " | " | 76 | 105 | 31 | 40 | 8.5 | O | O | " |
| 20 | | " | " | 50 | " | " | 82 | 108 | 23 | 32 | 7.2 | O | O | " |
| 21 | | " | " | 75% | " | " | 79 | 109 | 32 | 44 | 7.5 | O | O | " |
| 22 | | " | " | " | 1200° C. × 10 Hr, W.Q. | " | 75 | 106 | 35 | 47 | 7.7 | O | O | " |
| 23 | | " | " | " | 1000° C. × 5.0 Hr, W.Q. | " | 79 | 112 | 30 | 44 | 7.5 | O | O | " |
| 24 | | " | " | " | 1150° C. × 1.0 Hr, W.Q. | " | 84 | 112 | 22 | 32 | 5.4 | O | O | " |
| 25 | | " | " | " | 1050° C. × 1.0 Hr, W.Q. | 650° C. × 200 Hr, A.C. | 63 | 97 | 44 | 52 | 22 | O | O | " |
| 26 | | " | " | " | 1200° C. × 1.0 Hr, W.Q. | 650° C. × 100 Hr, A.C. | 92 | 113 | 23 | 31 | 5.7 | O | O | " |
| 27 | | " | " | " | " | 750° C. × 1.0 Hr, A.C. | 65 | 100 | 32 | 36 | 10 | O | O | " |
| 28 | | " | " | " | " | 500° C. × 200 Hr, A.C. | 63 | 92 | 46 | 50 | 25 | O | O | " |
| 29 | Comparative Alloys | 1250* | — | — | (Cracking) | | — | — | — | — | — | — | — | — |
| 30 | | 1200 | 750* | — | (Cracking) | | — | — | — | — | — | — | — | — |
| 31 | | 1150 | 900 | 75 | 1250° C. × 1.0 Hr, W.Q.* | 650° C. × 200 Hr, A.C. | 60 | 99 | 30 | 17 | 10 | O | O | I |
| 32 | | " | " | " | 950° C. × 1.0 Hr, W.Q.* | 650° C. × 100 Hr, A.C. | 88 | 112 | 14 | 15 | 2.7 | O | O | I + V |
| 33 | | " | " | " | 1150° C. × 1.0 Hr, W.Q. | 800° C. × 100 Hr, A.C.* | 42 | 86 | 39 | 36 | 10 | O | O | " |
| 34 | | " | " | " | " | 450° C. × 200 Hr, A.C.* | 33 | 72 | 55 | 67 | 30 | O | O | none |
| 35 | | " | " | " | " | 650° C. × 100 Hr, A.C. | 83 | 109 | 27 | 27 | 3.7 | X | X | I |
| 36 | | " | " | " | " | " | 69 | 105 | 36 | 42 | 11 | O | X | " |
| 37 | | " | " | " | " | " | 88 | 113 | 20 | 22 | 4.7 | X | O | " |
| 38 | | " | " | " | " | " | 81 | 106 | 24 | 24 | 6.7 | X | O | " |
| 39 | | " | " | " | " | " | 80 | 112 | 14 | 17 | 2.6 | X | O | " |
| 40 | | " | " | " | " | " | 75 | 104 | 32 | 41 | 8.8 | X | X | " |
| 41 | | " | " | " | " | " | 80 | 102 | 16 | 15 | 2.5 | X | X | " |
| 42 | | " | " | " | " | " | 83 | 109 | 11 | 12 | 3.7 | X | X | I + VII |
| 43 | | " | " | " | " | " | 76 | 106 | 17 | 18 | 5.1 | X | O | II + IV |
| 44 | | " | " | " | " | " | 29 | 67 | 52 | 70 | 33 | O | O | I |
| 45 | Conventional Alloys | " | " | " | " | 650° C. × 20 Hr, A.C. | 49 | 86 | 55 | 56 | 24 | O | X | VI |
| 46 | | " | " | " | " | 700° C. × 20 Hr, A.C. | 75 | 114 | 33 | 42 | 15 | X | X | " |
| 47 | | " | " | " | " | 750° C. × 20 Hr, A.C. | 88 | 121 | 22 | 19 | 6.0 | X | X | " |
| 48 | | " | " | " | " | 650° C. × 20 Hr, A.C. | 47 | 86 | 52 | 56 | 25 | O | X | " |

TABLE 2-continued

| Alloy No. | Class | Manufacturing Conditions: Hot Working Conditions: Initial Temp. | Finishing Temp. | Reduction in area | Heat Treatment Conditions | Ageing Conditions | Mechanical Properties: 0.2% Y.P. kgf/mm$^2$ | T.S. kgf/mm$^2$ | EL. % | D.R. % | I.V. kgf-m/cm$^2$ | Corrosion Resistance: SCCT | HCT | Type of Precipitate |
|---|---|---|---|---|---|---|---|---|---|---|---|---|---|---|
| 49 | | " | " | " | " | 700° C. × 20 Hr, A.C. | 68 | 109 | 34 | 38 | 14 | X | X | " |
| 50 | | " | " | " | " | 750° C. × 20 Hr, A.C. | 75 | 114 | 25 | 24 | 8.4 | X | O | " |
| 51 | | " | " | " | " | 650° C. × 20 Hr, A.C. | 37 | 80 | 61 | 65 | 30 | O | X | " |
| 52 | | " | " | " | " | 700° C. × 20 Hr, A.C. | 68 | 108 | 37 | 40 | 15 | O | X | " |
| 53 | | " | " | " | " | 750° C. × 20 Hr, A.C. | 70 | 109 | 36 | 40 | 13 | O | X | " |
| 54 | | " | " | " | " | 750° C. × 5.0 Hr, A.C. | 86 | 119 | 17 | 19 | 2.9 | X | X | " |
| 55 | | " | " | " | " | " | 67 | 106 | 35 | 31 | 8.4 | X | O | VIII |
| 56 | | " | " | " | " | " | 60 | 97 | 38 | 36 | 11 | X | O | " |

Note:
(1) *Outside the range of this invention
(2) Alloys Nos. 35–56 have alloy compositions falling outside the range of this invention
(3) Y.P.: Yielding point; T.S.: Tensile strength; EL.: Elongation; D.R.: Drawing ratio; I.V.: Impact value.
(4) SCCT: Stress corrosion cracking test; HCT: Hydrogen cracking test.
(5) Type of precipitate: I: $\gamma''$-$Ni_3Nb$; II: $\gamma''$-$Ni_3(Nb,Ta)$; III: $\gamma'$-$Ni_3(Nb,Al)$; IV: $\gamma'$-$Ni_3(Al,Ta,Nb)$; V: $\delta$-$Ni_3Nb$; VI: $\gamma'$-$Ni_3Ti$; VII: $\gamma'$-$Ni_3(Ti,Nb)$; VIII: $\gamma'$-$Ni_3(Ti,Al)$

TABLE 3

| Alloy No. | Class | CHEMICAL COMPOSITION (% by weight) C | Si | Mn | P | S | Ni | Cr | Mo | Fe | Ti | Al | Nb | N | Others |
|---|---|---|---|---|---|---|---|---|---|---|---|---|---|---|---|
| 1 | This Invention Alloys | 0.009 | 0.12 | 0.36 | 0.004 | 0.001 | 52.02 | 24.85 | 3.45 | 14.53 | 0.07 | 1.05 | 3.52 | 0.004 | 0.0024 Mg |
| 2 | | " | " | " | " | " | " | " | " | " | " | " | " | " | " |
| 3 | | " | " | " | " | " | " | " | " | " | " | " | " | " | " |
| 4 | | " | " | " | " | " | " | " | " | " | " | " | " | " | " |
| 5 | | " | " | " | " | " | " | " | " | " | " | " | " | " | " |
| 6 | | " | " | " | " | " | " | " | " | " | " | " | " | " | " |
| 7 | | 0.024 | 0.16 | 0.32 | 0.002 | 0.001 | 51.65 | 25.02 | 3.49 | 14.60 | 0.10 | 1.12 | 3.47 | 0.003 | 0.0016 Mg |
| 8 | | " | " | " | " | " | " | " | " | " | " | " | " | " | " |
| 9 | | " | " | " | " | " | " | " | " | " | " | " | " | " | " |
| 10 | | " | " | " | " | " | " | " | " | " | " | " | " | " | " |
| 11 | | " | " | " | " | " | " | " | " | " | " | " | " | " | " |
| 12 | | " | " | " | " | " | " | " | " | " | " | " | " | " | " |
| 13 | | 0.047 | 0.16 | 0.30 | 0.002 | 0.003 | 51.61 | 24.95 | 3.47 | 12.92 | 0.09 | 0.82 | 4.02 | 0.004 | 1.6 Cr, 0.004 B |
| 14 | | 0.008 | 0.47 | 0.31 | 0.003 | 0.001 | 52.43 | 24.88 | 3.63 | 11.90 | 0.06 | 1.02 | 3.56 | 0.003 | 1.7 Co, 0.0022 Mg |
| 15 | | 0.012 | 0.09 | 1.87 | 0.004 | 0.003 | 51.82 | 24.40 | 3.43 | 13.72 | 0.08 | 1.09 | 3.47 | 0.003 | 0.006 Ca |
| 16 | | 0.010 | 0.11 | 0.36 | 0.003 | 0.001 | 45.77 | 24.83 | 3.58 | 20.67 | 0.02 | 1.01 | 3.62 | 0.004 | 0.008 Y, 0.002 Zr |
| 17 | | 0.007 | 0.12 | 0.42 | 0.005 | 0.003 | 58.83 | 24.94 | 3.37 | 7.58 | 0.08 | 1.20 | 3.44 | 0.003 | 0.0020 Sn |
| 18 | | 0.010 | 0.18 | 0.42 | 0.002 | 0.001 | 51.21 | 18.76 | 3.67 | 21.01 | 0.03 | 1.00 | 3.67 | 0.023 | 0.007 Ce, 0.002 Y |
| 19 | | 0.013 | 0.18 | 0.44 | 0.005 | 0.003 | 50.97 | 26.87 | 3.33 | 12.41 | 0.10 | 1.12 | 3.36 | 0.002 | 1.2 W |
| 20 | | 0.007 | 0.08 | 0.38 | 0.002 | 0.001 | 52.09 | 24.78 | 2.58 | 12.97 | 0.03 | 1.15 | 4.23 | 0.003 | 1.7 Co |
| 21 | | 0.008 | 0.12 | 0.38 | 0.004 | 0.002 | 51.65 | 25.41 | 5.41 | 12.44 | 0.01 | 0.96 | 3.52 | 0.0012 | 0.004 Zn |
| 22 | | 0.015 | 0.16 | 0.36 | 0.003 | 0.001 | 50.69 | 25.92 | 3.67 | 14.33 | 0.37 | 0.99 | 3.48 | 0.003 | 0.006 B, 0.002 Ca |
| 23 | | 0.018 | 0.22 | 0.39 | 0.003 | 0.001 | 51.49 | 24.99 | 3.57 | 14.42 | 0.01 | 1.87 | 3.01 | 0.004 | 0.004 B |
| 24 | | 0.019 | 0.14 | 0.42 | 0.005 | 0.003 | 51.22 | 25.08 | 3.67 | 13.99 | 0.01 | 1.87 | 3.56 | 0.005 | 0.007 Pb, 0.003 Ca |
| 25 | Comparative Alloys | 0.009 | 0.10 | 0.82 | 0.004 | 0.001 | 51.87 | 24.87 | 3.55 | 14.37 | 0.10 | 0.88 | 3.42 | 0.003 | 0.0024 Mg |
| 26 | | " | " | " | " | " | " | " | " | " | " | " | " | " | " |
| 27 | | " | " | " | " | " | " | " | " | " | " | " | " | " | " |
| 28 | | " | " | " | " | " | " | " | " | " | " | " | " | " | " |
| 29 | | " | " | " | " | " | " | " | " | " | " | " | " | " | " |
| 30 | | " | " | " | " | " | " | " | " | " | " | " | " | " | " |
| 31 | | 0.070* | 0.24 | 0.88 | 0.005 | 0.002 | 51.29 | 24.76 | 3.51 | 14.60 | 0.10 | 0.87 | 3.66 | 0.003 | 0.0052 Mg |
| 32 | | 0.011 | 0.12 | 0.65 | 0.003 | 0.002 | 63.59* | 25.04 | 6.07* | None* | 0.14 | 0.80 | 3.47 | 0.002 | 0.006 B |
| 33 | | 0.008 | 0.63* | 0.45 | 0.002 | 0.001 | 41.43* | 24.35 | 3.83 | 24.71 | 0.11 | 0.92 | 3.56 | 0.003 | |
| 34 | | 0.009 | 0.14 | 0.87 | 0.005 | 0.005 | 51.68 | 28.24* | 3.41 | 11.18 | 0.72* | 0.29 | 3.44 | 0.004 | 0.003 Ca |
| 35 | | 0.008 | 0.24 | 1.23 | 0.003 | 0.004 | 58.91 | 24.23 | 10.23* | 0.85 | 0.39 | 0.33 | 3.56 | 0.005 | 0.007 Pb |
| 36 | | 0.013 | 0.16 | 0.99 | 0.005 | 0.007 | 51.23 | 25.77 | 3.38 | 12.76 | 0.10 | 3.02* | 2.56 | 0.003 | 0.004 Ca, 0.002 Ce |
| 37 | Conventional Alloys | 0.005 | 0.27 | 0.63 | 0.007 | 0.003 | 50.17 | 24.87 | 3.33 | 17.80 | 2.69* | 0.15 | None* | 0.003 | 0.0093 Mg, 0.004 B |
| 38 | | " | " | " | " | " | " | " | " | " | "* | " | None* | " | 0.0093 Mg, 0.004 B |
| 39 | | " | " | " | " | " | " | " | " | " | "* | " | None* | " | 0.0093 Mg, 0.004 B |
| 40 | | 0.008 | 0.26 | 0.60 | 0.009 | 0.003 | 57.49 | 24.33 | 3.26 | 11.20 | 2.58* | 0.13 | None* | 0.003 | 0.007 Mg, 0.003 B |
| 41 | | 0.006 | 0.25 | 0.64 | 0.008 | 0.003 | 68.00* | 25.11 | 3.41 | None* | 2.72* | 0.13 | None* | 0.004 | 0.006 Mg |
| 42 | | 0.016 | 0.010 | 0.81 | 0.002 | 0.004 | 50.30 | 24.43 | 3.24 | 17.70 | 3.37* | 0.12 | None* | 0.002 | 0.008 Mg |
| 43 | | 0.016 | 0.008 | 0.78 | 0.001 | 0.003 | 49.79 | 24.27 | 3.28 | 17.79 | 1.69* | 2.22* | None* | 0.003 | 0.009 Mg |
| 44 | | 0.015 | 0.012 | 0.83 | 0.001 | 0.003 | 49.13 | 24.05 | 3.26 | 17.93 | 0.83* | 3.93* | None* | 0.006 | 0.006 Mg |

*Outside the range of this invention

TABLE 4

| Alloy No. | Class | Manufacturing Conditions: Hot Working Conditions: Initial Temp. | Finishing Temp. | Reduction in area | Heat Treatment Conditions | Ageing Conditions | Mechanical Properties: 0.2% Y.P. kgf/mm² | T.S. kgf/mm² | EL. % | D.R. % | I.V. kgf-m/cm² | Corrosion Resistance: SCCT | HCT | Type of Precipitate |
|---|---|---|---|---|---|---|---|---|---|---|---|---|---|---|
| 1 | This Invention Alloys | 1200° C. | 800° C. | 75% | 1200° C. × 1.0 Hr, W.Q. | 700° C. × 20 Hr, A.C. | 85 | 119 | 24 | 39 | 7.8 | O | O | I + III |
| 2 | | " | " | " | 1200° C. × 3 min, W.Q. | 650° C. × 20 Hr, A.C. | 92 | 124 | 34 | 45 | 13 | O | O | " |
| 3 | | " | " | " | " | 600° C. × 20 Hr, A.C. | 87 | 120 | 36 | 50 | 17 | O | O | " |
| 4 | | " | " | " | 1000° C. × 1.0 Hr, W.Q. | 700° C. × 20 Hr, A.C. | 88 | 124 | 27 | 40 | 7.0 | O | O | " |
| 5 | | " | " | " | " | 650° C. × 20 Hr, A.C. | 96 | 130 | 31 | 47 | 12 | O | O | " |
| 6 | | " | " | " | 1000° C. × 5.0 Hr, W.Q. | 600° C. × 20 Hr, A.C. | 88 | 121 | 39 | 54 | 18 | O | O | " |
| 7 | | 1000 | 900 | 50 | 1200° C. × 1.0 Hr, W.Q. | 700° C. × 50 Hr, A.C. | 96 | 129 | 22 | 36 | 7.0 | O | O | " |
| 8 | | " | " | " | " | 650° C. × 50 Hr, A.C. | 84 | 117 | 30 | 41 | 11 | O | O | " |
| 9 | | " | " | " | " | 600° C. × 50 Hr, A.C. | 87 | 118 | 45 | 51 | 17 | O | O | " |
| 10 | | " | " | " | 1000° C. × 1.0 Hr, W.Q. | 700° C. × 50 Hr, A.C. | 90 | 130 | 26 | 35 | 7.2 | O | O | " |
| 11 | | " | " | " | " | 650° C. × 50 Hr, A.C. | 95 | 131 | 30 | 40 | 11 | O | O | " |
| 12 | | " | " | " | " | 600° C. × 50 Hr, A.C. | 88 | 117 | 36 | 47 | 14 | O | O | " |
| 13 | | 1150 | " | 80 | 1150° C. × 1.0 Hr, W.Q. | 650° C. × 100 Hr, A.C. | 98 | 120 | 24 | 38 | 8.9 | O | O | " |
| 14 | | " | " | " | " | " | 96 | 116 | 27 | 42 | 10 | O | O | " |
| 15 | | " | " | " | " | " | 94 | 128 | 29 | 47 | 9.3 | O | O | " |
| 16 | | " | " | " | " | " | 96 | 125 | 28 | 42 | 12 | O | O | " |
| 17 | | " | " | " | " | " | 80 | 116 | 37 | 48 | 14 | O | O | " |
| 18 | | " | " | " | " | " | 82 | 120 | 34 | 42 | 10 | O | O | " |
| 19 | | " | " | " | " | " | 81 | 118 | 31 | 51 | 14 | O | O | " |
| 20 | | " | " | " | " | " | 93 | 127 | 27 | 43 | 9.0 | O | O | " |
| 21 | | 1150° C. | 900° C. | 80% | 1150° C. × 1.0 Hr, W.Q. | 700° C. × 10 Hr-(F.C.) −650° C. × 50 Hr, A.C. | 80 | 114 | 31 | 45 | 16 | O | O | I + III |
| 22 | | " | " | " | " | 700° C. × 10 Hr, W.Q. +650° C. × 50 Hr, A.C. | 88 | 122 | 24 | 42 | 11 | O | O | " |
| 23 | | " | " | " | 1200° C. × 1.0 Hr, W.Q. | 500° C. × 20 Hr, A.C. | 80 | 120 | 27 | 49 | 19 | O | O | " |
| 24 | | " | " | " | " | 750° C. × 1.0 Hr, A.C. | 82 | 126 | 21 | 31 | 9.4 | O | O | " |
| 25 | Comparative Alloys | 1250* | — | — | (Cracking) | — | — | — | — | — | — | — | — | |
| 26 | | 1200 | 750* | — | (Cracking) | — | — | — | — | — | — | — | — | |
| 27 | | 1150 | 900 | 75 | 1250° C. × 1.0 Hr, W.Q.* | 650° C. × 200 Hr, A.C. | 70 | 108 | 10 | 17 | 4.8 | O | O | I + III |
| 28 | | " | " | " | 950° C. × 1.0 Hr, W.Q.* | 650° C. × 100 Hr, A.C. | 80 | 115 | 14 | 24 | 3.2 | O | O | " |
| 29 | | " | " | " | 1150° C. × 1.0 Hr, W.Q. | 800° C. × 20 Hr, A.C.* | 48 | 88 | 9 | 16 | 4.0 | O | O | I + III + V |
| 30 | | " | " | " | " | 450° C. × 200 Hr, A.C.* | 38 | 79 | 49 | 45 | 17 | O | O | none |
| 31 | | " | " | " | " | 650° C. × 100 Hr, A.C. | 87 | 124 | 17 | 29 | 4.4 | X | X | I + III |
| 32 | | " | " | " | " | " | 70 | 116 | 21 | 38 | 7.2 | O | X | " |
| 33 | | " | " | " | " | " | 92 | 124 | 14 | 21 | 4.8 | X | X | " |
| 34 | | " | " | " | " | " | 84 | 114 | 12 | 27 | 3.1 | X | X | " |
| 35 | | " | " | " | " | " | 68 | 102 | 16 | 24 | 6.1 | O | X | " |
| 36 | | " | " | " | " | " | 98 | 130 | 11 | 17 | 3.6 | X | X | " |
| 37 | Conventional Alloys | 1150° C. | 900° C. | 75% | 1150° C. × 1.0 Hr, W.Q. | 650° C. × 20 Hr, A.C. | 49 | 86 | 55 | 56 | 24 | O | X | VI |
| 38 | | " | " | " | " | 700° C. × 20 Hr, A.C. | 75 | 114 | 33 | 42 | 15 | X | X | " |
| 39 | | " | " | " | " | 750° C. × 20 Hr, A.C. | 84 | 119 | 20 | 19 | 6.0 | X | X | " |
| 40 | | " | " | " | " | 700° C. × 20 Hr, A.C. | 68 | 109 | 34 | 38 | 14 | X | X | " |
| 41 | | " | " | " | " | " | 62 | 107 | 37 | 40 | 15 | O | X | " |
| 42 | | " | " | " | " | 750° C. × 5.0 Hr, A.C. | 86 | 119 | 17 | 19 | 2.9 | X | X | " |
| 43 | | " | " | " | " | " | 67 | 106 | 35 | 31 | 8.4 | X | O | VIII |
| 44 | | " | " | " | " | " | 60 | 97 | 38 | 36 | 11 | X | O | " |

*Outside the range of this invention

TABLE 5

| Alloy No. | Class | CHEMICAL COMPOSITION (% by weight) C | Si | Mn | P | S | Ni | Cr | Mo | Fe | Ti | Al | Nb | N | Co | Others |
|---|---|---|---|---|---|---|---|---|---|---|---|---|---|---|---|---|
| 1 | This Invention Alloys | 0.009 | 0.07 | 0.31 | 0.002 | 0.002 | 51.02 | 24.97 | 3.46 | 6.29 | 0.08 | 0.07 | 3.84 | 0.0047 | 9.87 | 0.0046 Mg |
| 2 | | " | " | " | " | " | " | " | " | " | " | " | " | " | " | " |
| 3 | | " | " | " | " | " | " | " | " | " | " | " | " | " | " | " |
| 4 | | " | " | " | " | " | " | " | " | " | " | " | " | " | " | " |
| 5 | | " | " | " | " | " | " | " | " | " | " | " | " | " | " | " |
| 6 | | " | " | " | " | " | " | " | " | " | " | " | " | " | " | " |
| 7 | | 0.016 | 0.14 | 0.38 | 0.003 | 0.002 | 50.98 | 25.08 | 3.66 | 5.27 | 0.07 | 1.02 | 3.66 | 0.0033 | 9.71 | 0.0032 Mg |
| 8 | | " | " | " | " | " | " | " | " | " | " | " | " | " | " | " |
| 9 | | 0.044 | 0.16 | 0.31 | 0.002 | 0.001 | 51.83 | 25.02 | 3.50 | 8.02 | 0.06 | 0.08 | 3.75 | 0.0052 | 7.21 | 0.003 B |
| 10 | | 0.012 | 0.47 | 0.37 | 0.004 | 0.002 | 51.27 | 24.76 | 3.36 | 5.35 | 0.10 | 0.98 | 3.77 | 0.024 | 8.33 | 1.2 Cu |
| 11 | | 0.014 | 0.18 | 1.92 | 0.002 | 0.001 | 50.88 | 25.21 | 3.56 | 8.12 | 0.38 | 0.12 | 3.51 | 0.0034 | 6.09 | 0.0048 Ca |
| 12 | | 0.009 | 0.14 | 0.36 | 0.003 | 0.001 | 45.87 | 24.96 | 3.47 | 13.23 | 0.14 | 0.92 | 3.64 | 0.0067 | 7.24 | 0.0072 Y |
| 13 | | 0.019 | 0.16 | 0.37 | 0.002 | 0.001 | 58.02 | 21.07 | 3.40 | 4.40 | 0.07 | 0.09 | 3.88 | 0.0026 | 8.14 | 0.37 Ta, 0.0028 Mg |
| 14 | | 0.007 | 0.14 | 0.32 | 0.002 | 0.001 | 51.53 | 18.21 | 3.86 | 12.51 | 0.06 | 1.13 | 3.74 | 0.0031 | 8.48 | 0.009 Ce |
| 15 | | 0.015 | 0.16 | 0.32 | 0.002 | 0.002 | 50.86 | 26.65 | 3.47 | 6.48 | 0.09 | 0.13 | 3.52 | 0.0046 | 7.10 | 1.2 W |
| 16 | | 0.008 | 0.21 | 0.58 | 0.003 | 0.002 | 51.24 | 24.95 | 2.61 | 7.21 | 0.12 | 1.07 | 3.72 | 0.0042 | 8.27 | 0.0036 Mg |
| 17 | | 0.010 | 0.22 | 0.65 | 0.002 | 0.001 | 51.78 | 24.16 | 5.37 | 4.76 | 0.12 | 0.22 | 4.67 | 0.0031 | 8.01 | 0.007 B, 0.012 Ca |
| 18 | | 0.007 | 0.16 | 0.33 | 0.002 | 0.001 | 51.55 | 25.11 | 3.35 | 7.12 | 0.22 | 1.89 | 3.02 | 0.0047 | 7.23 | 0.006 Zn |
| 19 | | 0.012 | 0.33 | 0.72 | 0.002 | 0.001 | 52.05 | 24.85 | 3.56 | 6.47 | 0.13 | 0.12 | 3.76 | 0.027 | 7.96 | 0.004 Pb |
| 20 | | 0.006 | 0.14 | 0.35 | 0.003 | 0.002 | 50.24 | 23.03 | 3.64 | 3.46 | 0.11 | 1.00 | 3.54 | 0.0030 | 14.47 | 0.0026 Mg |
| 21 | Comparative Alloys | 0.013 | 0.14 | 0.39 | 0.002 | 0.001 | 51.83 | 25.20 | 3.57 | 4.36 | 0.09 | 0.94 | 3.37 | 0.0043 | 10.06 | 0.0038 Mg |
| 22 | | " | " | " | " | " | " | " | " | " | " | " | " | " | " | " |
| 23 | | " | " | " | " | " | " | " | " | " | " | " | " | " | " | " |
| 24 | | " | " | " | " | " | " | " | " | " | " | " | " | " | " | " |
| 25 | | " | " | " | " | " | " | " | " | " | " | " | " | " | " | " |
| 26 | | " | " | " | " | " | " | " | " | " | " | " | " | " | " | " |
| 27 | This Invention Alloys | 0.049 | 0.10 | 0.63 | 0.004 | 0.004 | 51.51 | 24.95 | 3.52 | 13.40 | 0.009 | 0.54 | 3.69 | 0.0039 | 1.50 | |
| 28 | | 0.008 | 0.47 | 0.31 | 0.003 | 0.001 | 52.43 | 24.88 | 3.63 | 11.90 | 0.06 | 1.02 | 3.56 | 0.003 | None | 1.6 Cu, 0.004 B |
| 29 | | 0.012 | 0.24 | 1.80 | 0.004 | 0.003 | 52.02 | 24.59 | 3.37 | 12.7 | 0.10 | 0.59 | 3.16 | 0.0052 | 1.1 | 0.0060 Ca |
| 30 | | 0.010 | 0.11 | 0.36 | 0.003 | 0.001 | 45.77 | 24.83 | 3.58 | 20.67 | 0.02 | 1.01 | 3.62 | 0.004 | None | 0.008 Y, 0.002 Zr |
| 31 | | 0.012 | 0.24 | 0.66 | 0.004 | 0.004 | 59.46 | 25.34 | 3.34 | 6.80 | 0.12 | 0.40 | 3.00 | 0.0064 | " | 0.60 Ta, 0.0090 Mg |
| 32 | | 0.010 | 0.18 | 0.42 | 0.002 | 0.001 | 51.21 | 18.76 | 3.67 | 21.01 | 0.03 | 1.00 | 3.67 | 0.023 | " | 0.007 Ce, 0.002 Y |
| 33 | | 0.012 | 0.24 | 0.66 | 0.005 | 0.004 | 50.23 | 26.89 | 3.52 | 12.83 | 0.13 | 0.47 | 3.20 | 0.0054 | " | 1.80 W, 0.0060 B |
| 34 | Conventional Alloys | 0.005 | 0.27 | 0.63 | 0.007 | 0.003 | 50.17 | 24.87 | 3.33 | 17.80 | 2.69* | 0.15 | None* | 0.003 | " | 0.0093 Mg, 0.004 B |
| 35 | | " | " | " | " | " | " | " | " | " | " | " | None* | " | " | " |
| 36 | | " | " | " | " | " | " | " | " | " | " | " | None* | " | " | " |
| 37 | | 0.008 | 0.26 | 0.60 | 0.009 | 0.003 | 57.49 | 24.33 | 3.26 | 11.20 | 2.58* | 0.13 | None* | 0.003 | " | 0.007 Mg, 0.003 B |
| 38 | | 0.006 | 0.25 | 0.64 | 0.008 | 0.003 | 68.00* | 25.11 | 3.41 | None* | 2.72* | 0.13 | None* | 0.004 | " | 0.006 Mg |
| 39 | | 0.016 | 0.010 | 0.81 | 0.002 | 0.004 | 50.30 | 24.43 | 3.24 | 17.70 | 3.37* | 0.12 | None* | 0.002 | " | 0.008 Mg |
| 40 | | 0.016 | 0.008 | 0.78 | 0.001 | 0.003 | 49.79 | 24.27 | 3.28 | 17.79 | 1.69* | 2.22* | None* | 0.003 | " | 0.009 Mg |
| 41 | | 0.015 | 0.012 | 0.83 | 0.001 | 0.003 | 49.13 | 24.05 | 3.26 | 17.93 | 0.83* | 3.93* | None* | 0.006 | " | 0.006 Mg |

*Outside the range of this invention

TABLE 6

| Alloy No. | Class | Manufacturing Conditions: Hot Working Conditions: Initial Temp. | Finishing Temp. | Reduction in area | Heat Treatment Conditions | Ageing Conditions | Mechanical Properties: 0.2% Y.P. kgf/mm² | T.S. kgf/mm² | EL. % | D.R. % | I.V. kgf-m/cm² | Corrosion Resistance: SCCT | HCT | Type of Precipitate |
|---|---|---|---|---|---|---|---|---|---|---|---|---|---|---|
| 1 | This Invention Alloys | 1200° C. | 800° C. | 75% | 1200° C. | 700° C. × 20 Hr, A.C. | 83 | 117 | 27 | 40 | 10 | O | O | I |
| 2 | | " | " | " | 1200° C. × 3 min, W.Q. | 650° C. × 20 Hr, A.C. | 78 | 112 | 42 | 43 | 18 | O | O | " |
| 3 | | " | " | " | " | 600° C. × 20 Hr, A.C. | 65 | 97 | 58 | 61 | 23 | O | O | " |
| 4 | | " | " | " | 1000° C. × 1.0 Hr, W.Q. | 700° C. × 20 Hr, A.C. | 85 | 121 | 24 | 36 | 8 | O | O | " |
| 5 | | " | " | " | " | 650° C. × 20 Hr, A.C. | 79 | 114 | 40 | 41 | 16 | O | O | " |
| 6 | | " | " | " | 1000° C. × 5.0 Hr, W.Q. | 600° C. × 20 Hr, A.C. | 66 | 100 | 57 | 60 | 21 | O | O | " |
| 7 | | 1000 | 900 | 50 | 1200° C. × 1.0 Hr, W.Q. | 650° C. × 20 Hr, A.C. | 92 | 120 | 25 | 37 | 9.6 | O | O | I + III |
| 8 | | " | " | " | 1000° C. × 1.0 Hr, W.Q. | 650° C. × 20 Hr, A.C. | 98 | 130 | 27 | 42 | 10 | O | O | " |
| 9 | | 1150 | " | 80 | 1150° C. × 1.0 Hr, W.Q. | 750° C. × 50 Hr-(F.C.)-625° C. × 15 hr, A.C. | 86 | 117 | 32 | 41 | 13 | O | O | I |
| 10 | | " | " | " | " | 750° C. × 50 Hr-(F.C.)-625° C. × 15 hr, A.C. | 94 | 123 | 29 | 40 | 11 | O | O | I + III |
| 11 | | " | " | " | " | 750° C. × 50 Hr-(F.C.)-625° C. × 15 hr, A.C. | 84 | 110 | 31 | 40 | 10 | O | O | I |
| 12 | | " | " | " | " | 750° C. × 50 Hr-(F.C.)-625° C. × 15 hr, A.C. | 96 | 123 | 21 | 36 | 9.2 | O | O | I + III |
| 13 | | " | " | " | " | 750° C. × 50 Hr-(F.C.)-625° C. × 15 hr, A.C. | 79 | 110 | 34 | 43 | 13 | O | O | I |
| 14 | | " | " | " | " | 750° C. × 50 Hr-(F.C.)-625° C. × 15 hr, A.C. | 83 | 117 | 37 | 43 | 16 | O | O | I + III |
| 15 | | " | " | " | " | 750° C. × 50 Hr-(F.C.)-625° C. × 15 hr, A.C. | 80 | 114 | 36 | 45 | 17 | O | O | I |
| 16 | | " | " | " | " | 750° C. × 50 Hr-(F.C.)-625° C. × 15 hr, A.C. | 85 | 118 | 36 | 48 | 15 | O | O | I + III |
| 17 | | " | " | " | " | 750° C. × 50 Hr-(F.C.)-625° C. × 15 hr, A.C. | 91 | 119 | 21 | 32 | 9.1 | O | O | I |
| 18 | | " | " | " | " | 750° C. × 50 Hr-(F.C.)-625° C. × 15 hr, A.C. | 84 | 112 | 23 | 32 | 11 | O | O | I + III |
| 19 | | " | " | " | " | 750° C. × 50 Hr-(F.C.)-625° C. × 15 hr, A.C. | 81 | 110 | 34 | 42 | 13 | O | O | I |
| 20 | | " | " | " | " | 750° C. × 50 Hr-(F.C.)-625° C. × 15 hr, A.C. | 97 | 124 | 23 | 34 | 9.6 | O | O | I + III |
| 21 | Comparative Alloys | 1250° C. | — | — | (Cracking) | — | — | — | — | — | — | — | — | I + III |
| 22 | | 1200° C. | 750° C. | — | (Cracking) | — | — | — | — | — | — | — | " | |
| 23 | | 1150 | 900 | 80% | 1250° C. × 1.0 Hr, W.Q.* | 650° C. × 20 Hr, A.C. | 62 | 103 | 40 | 34 | 12 | O | O | " |
| 24 | | " | " | " | 950° C. × 1.0 Hr, W.Q.* | " | 80 | 112 | 13 | 27 | 6.1 | O | O | " |
| 25 | | " | " | " | 1150° C. × 1.0 Hr, W.Q.* | 800° C. × 20 Hr, A.C.* | 52 | 91 | 27 | 32 | 8.4 | O | O | " |
| 26 | | " | " | " | " | 450° C. × 200 Hr, A.C.* | 37 | 74 | 51 | 50 | 18 | O | O | " |
| 27 | This Invention Alloys | " | " | 75 | " | 650° C. × 100 Hr, A.C. | 84 | 114 | 29 | 39 | 7.2 | O | O | " |
| 28 | | " | " | 80 | " | " | 96 | 116 | 27 | 42 | 10 | O | O | " |
| 29 | | " | " | 75 | " | " | 86 | 109 | 26 | 37 | 6.7 | O | O | " |
| 30 | | " | " | 80 | " | " | 96 | 125 | 28 | 42 | 12 | O | O | " |
| 31 | | " | " | 75 | " | " | 76 | 105 | 31 | 40 | 8.5 | O | O | " |
| 32 | | " | " | 80 | " | " | 82 | 120 | 34 | 42 | 10 | O | O | " |
| 33 | | " | " | 75 | " | " | 79 | 109 | 32 | 44 | 7.5 | O | O | " |
| 34 | Conventional | " | " | " | " | " | 49 | 86 | 55 | 56 | 24 | O | X | VI |
| 35 | | " | " | " | " | 700° C. × 20 Hr, A.C. | 75 | 114 | 33 | 42 | 15 | X | X | " |

TABLE 6-continued

| Alloy No. | Class | Manufacturing Conditions: Hot Working Conditions: Initial Temp. | Finishing Temp. | Reduction in area | Heat Treatment Conditions | Ageing Conditions | Mechanical Properties: 0.2% Y.P. kgf/mm² | T.S. kgf/mm² | EL. % | D.R. % | I.V. kgf-m/cm² | Corrosion Resistance: SCCT | HCT | Type of Precipitate |
|---|---|---|---|---|---|---|---|---|---|---|---|---|---|---|
| 36 | Alloys | " | " | " | " | 750° C. × 20 Hr, A.C. | 84 | 119 | 20 | 19 | 6.0 | X | X | " |
| 37 | | " | " | " | " | 700° C. × 20 Hr, A.C. | 68 | 109 | 34 | 38 | 14 | X | X | " |
| 38 | | " | " | " | " | " | 62 | 107 | 37 | 40 | 15 | O | X | " |
| 39 | | " | " | " | " | 750° C. × 5.0 Hr, A.C. | 86 | 119 | 17 | 19 | 2.9 | X | X | " |
| 40 | | " | " | " | " | " | 67 | 106 | 35 | 31 | 8.4 | X | O | VIII |
| 41 | | " | " | " | " | " | 60 | 97 | 38 | 36 | 11 | X | O | " |

*Outside the range of this invention

What is claimed is:

1. A precipitation-hardening Ni-base alloy exhibiting improved resistance to corrosion under a corrosive environment containing at least one of hydrogen sulfide, carbon dioxide and chloride ions, said alloy being of the $\gamma''$-phase precipitation hardening type and consisting of:

C: not greater than 0.050,
Si: not greater than 0.50%,
Mn: not greater than 2.0%,
Ni: 40–60%,
Cr: 18–27%,
Ti: less than 0.40%,
Mo: 2.5–5.5% and/or W: not greater than 11% such that $2.5\% \leqq Mo + \frac{1}{2}W \leqq b\ 5.5\%$,
Al: less than 0.03%,
Nb: 2.5–6.0% and/or Ta: not greater than 2.0%, $2.5\% \leqq Nb + \frac{1}{2}Ta \leqq 6.0\%$,
S: not greater than 0.0050%, N: not greater than 0.030%,
P: not greater than 0.020%,
Co: 0–15%,
Cu: 0–2.0%,
B: 0–0.10%,
REM: 0–0.150%,
Mg: 0–0.10%
Ca: 0–0.10%,
Y: 0–0.20%,
Fe and incidental impurities; balance, and wherein said alloy contains $\gamma''$-phase of $Ni_3Nb$ or $Ni_3(Nb, Ta)$.

2. A precipitation-hardening Ni-base alloy as defined in claim 1, in which Ti is restricted to less than 0.20%.

3. A precipitation-hardening Ni-base alloy as defined in claim 1, in which,

C: not greater than 0.020%,
Ni: not less than 45%,
Cr: 22–27%,
Ti: less than 0.20%.

4. A precipitation-hardening Ni-base alloy as defined in claim 1, in which,

C: not greater than 0.020%,
Ni: 50–55%,
Cr: 22–27%,
Ti: less than 0.20%,
Al: less than 0.15%,
S: not greater than 0.0010%, N: not greater than 0.010%,
P: not greater than 0.015%,
Co: 0–15%, 5. A precipitation-hardening Ni-base alloy exhibiting improved resistance to corrosion under a corrosive environment containing at least one of hydrogen sulfide, carbon dioxide and chloride ions, said alloy being of the $(\gamma'+\gamma'')$-phase precipitation hardening type and consisting of:

C: not greater than 0.050%,
Si: not greater than 0.50%, Mn:
not greater than 2.0%,
Ni: 40–60%,
Cr: 18–27%,
Mo: 2.5–5.5% and/or W: not greater than 11% such that $2.5\% \leqq Mo + \frac{1}{2}W \leqq 5.5\%$,
Al: 0.3–2.0%,
Ti: less than 0.4%
Nb: 2.5–6.0% and/or Ta: not greater than 2.0%, $2.5\% \leqq Nb + \frac{1}{2}Ta \leqq 6.0\%$,
Co: 0–15%,
S: not greater than 0.0050%,
N: not greater than 0.030%,
P: not greater than 0.020%,
Cu: 0–2.0%,
B: 0–0.10%,
REM: 0–0.10%,
Mg: 0–0.10%,
Ca: 0–0.10%,
Y: 0–0.20%,
Fe and incidental impurities: balance, and wherein said alloy contain $\gamma''$-phase of $Ni_3Nb$ or $Ni_3(Nb, Ta)$.

6. A precipitation-hardening Ni-base alloy as defined in claim 5, in which the content of Co is 2.0–15%.

7. A precipitation-hardening Ni-base alloy as defined in claim 5, in which Ti is restricted to less than 0.20%.

8. A precipitation-hardening Ni-base alloy as defined in claim 5, in which,

C: not greater than 0.020%,
Ni: not less than 45%,
Cr: 22–27%,
Ti: less than 0.20%.
Co: 2.0–15%.

9. A method of producing a precipitation-hardening Ni-base alloy exhibiting improved resistance to corrosion under a corrosive environment containing at least one of hydrogen sulfide, carbon dioxide and chloride ions, said alloy being of the precipitation hardening type and consisting of:

C: not greater than 0.050%,
Si: not greater than 0.50%,
Mn: not greater than 2.0%,
Ni: 40–60%,
Cr: 18–27%,
Mo: 2.5–5.5% and/or W: not greater than 11% such that $2.5\% \leqq Mo + \frac{1}{2}W \leqq 5.5\%$,
Al: not greater than 2.0%,
Ti: less than 0.40%
Nb: 2.5–6.0% and/or Ta: not greater than 2.0% $2.5\% \leqq Nb + \frac{1}{2}Ta \leqq 6.0\%$,
S: not greater than 0.0050%,
N: not greater than 0.030%,
P: not greater than 0.020%,
Co: 0–15%,
Cu: 0–2.0%,
B: 0–0.10%,
REM: 0–0.10%,
Mg: 0–0.10%,
Ca: 0–0.10%,
Y: 0–0.20%,
Fe and incidental impurities: balance, and wherein said alloy contains $\gamma''$-phase of $Ni_3NB$ or $Ni_3(Nb,Ta)$ said method comprising hot rolling said alloy with a reduction in area of 50% or more within a temperature range of 1200° C. and 800° C., maintaining the thus hot rolled alloy at a temperature of 100°–1200° C. for from about 3 minutes to 5 hours, followed by cooling at a cooling rate higher than the air cooling, wherein the cooling rate within a temperature range of between 300° C. and 500° C. is 10 C/min or higher, then carrying out ageing one or more times at a temperature of 500° C.–750° C. for from one hour to 200 hours.

10. A method of producing a precipitation-hardening Ni-base alloy as defined in claim 9, in which the hot rolling is carried out at a temperature range of 1150°–850° C.

11. A method of producing a precipitation-hardening Ni-base alloy as defined in claim 9, in which after hot rolling the alloy is maintained at a temperature of 1050°–1150° C. for ten minutes to 5 hours.

12. A method as defined in claim 9, in which said alloy is of the $\gamma''$-phase precipitation hardening type and the Al content is restricted to less than 0.3%.

13. A method as defined in claim 9, in which said alloy is of the $(\gamma'+\gamma'')$-phase precipitation hardening type and the Al content is restricted to 0.3–2.0% and the Co content is 2.0–15%.

14. The article of the precipitation-hardened Ni-base alloy prepared through the method defined in claim 9.

* * * * *